United States Patent [19]

Nester

[11] 4,302,316

[45] Nov. 24, 1981

[54] NON-CONTACTING TECHNIQUE FOR ELECTROPLATING X-RAY LITHOGRAPHY

[75] Inventor: James F. Nester, Ridgefield, Conn.

[73] Assignee: The Perkin-Elmer Corporation, Norwalk, Conn.

[21] Appl. No.: 147,662

[22] Filed: May 7, 1980

[51] Int. Cl.[3] ..... C25D 17/06; C25D 17/12

[52] U.S. Cl. ..... 204/224 R; 204/297 W

[58] Field of Search ..... 204/15, 297 W, 224 R

[56] References Cited

U.S. PATENT DOCUMENTS 4,042,480 8/1977 Noz ..... 204/297 W 4,043,894 8/1977 Gibbs ..... 204/297 W

OTHER PUBLICATIONS

IEEE Transactions on Magnetics, MAG-10, (1974), pp. 828-831.

*Primary Examiner*—T. M. Tufariello

*Attorney, Agent, or Firm*—S. A. Giarratana; E. T. Grimes; T. P. Murphy

[57] ABSTRACT

An apparatus and method for coating a substrate. An electrically conductive substrate is placed in an electrolytic bath with the surface to be coated facing the anode. The cathode is placed near but not touching the other side of the substrate and an electric potential is applied to both electrodes. Means are provided to prevent electroplating of the cathode.

1 Claim, 1 Drawing Figure

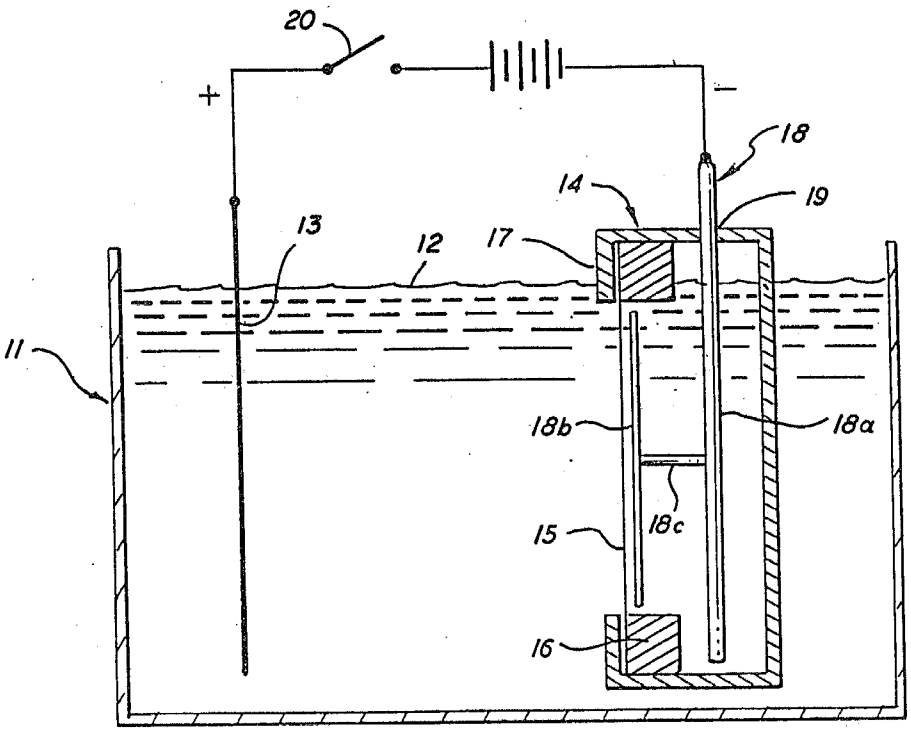
20
+
13
12
17
14
−
18
19
18a
18b
18c
15
16
11

NON-CONTACTING TECHNIQUE FOR ELECTROPLATING X-RAY LITHOGRAPHY

BACKGROUND OF THE INVENTION

An important step in the fabrication of integrated circuits is the use of masks on which circuit patterns have been formed by any one of a number of techniques. The circuit pattern is then projected onto a silicon wafer containing a photosensitive coating e.g. photoresist by the use of radiation such as ultraviolet light or X-rays. Since X-rays have substantially shorter wavelengths than ultraviolet light, X-ray lithography permits much finer pattern line discrimination resulting in the more efficient utilization of space on the wafer.

Masks used in X-ray lithography need not be optically transparent because X-rays are transmissable through optically opaque material. Thus, the mask may be made of optically opaque materials such as metals. An advantage of metals as mask substrates is their relative resistance to dimensional change as compared to, e.g., plastics.

The circuit pattern formed on the X-ray mask may consist of an X-ray absorbing material such as gold deposited in the shape of that pattern (positive mask) or as nonabsorbing pattern shapes imbedded in a field of absorbing material (negative mask). For either positive or negative X-ray circuit masks a necessary step is the deposition of a layer of absorbing material, e.g., gold. One such method for coating a metal substrate with gold or similar metal is by the well known technique of electroplating wherein the substrate which is made of a conductive metal is physically connected to the cathode.

Practical X-ray lithography systems employ so-called soft X-rays with low penetration power necessitating very thin mask substrates. Since the substrate which may be of the order of 1 μm thick and several inches in diameter is fragile and easily damaged, achievement of good coating without physical contact between the substrate and cathode is highly desirable.

The present invention relates to an apparatus and method for electroplating a mask substrate with gold or similar X-ray absorbing metal without any potentially damaging contact between the substrate and the solid electrode comprising the cathode.

SUMMARY OF THE INVENTION

The present invention relates to a method and apparatus for coating an electrically conductive substrate with a layer of metal such as gold. A liquid-tight housing containing an electrically conductive liquid is submerged in electroplating solution. The substrate to be coated forms a wall of the housing with the surface of the substrate to be coated opposite an anode. A cathode is fixed within the housing at a predetermined distance from the other surface of the substrate. A d.c. voltage is connected between the anode and cathode to cause metal ions to travel toward the cathode and deposit on the substrate.

DESCRIPTION OF THE DRAWING

The FIGURE illustrates an embodiment of the present invention.

DESCRIPTION

The FIGURE shows a tank 11 containing an appropriate plating solution 12 such as acid gold cyanide. An anode 13 is disposed within tank 11. The anode 13 may be made of stainless steel or a platinum coated titanium wire mesh.

A housing 14 has a cross sectional configuration to accommodate the substrate to be coated. For example, in a practical embodiment the cross-sectional shape of the housing 14 is circular to accommodate a mask substrate and support which are circular. The housing 14 is made of an electrical non-conductive material such as nylon to prevent electroplating of the housing itself.

A substrate 15 to be coated fixed to annular support 16 is placed within housing 14 with the surface to be coated facing anode 13. Extension 17 of housing 14 overlaps substrate 15 and defines the circular area exposed to the coating ions.

Within housing 14 is a cathode 18. Part of cathode 18 is shown protruding through an opening 19 in housing 14.

The protruding end of rod portion **18*a* of cathode 18** is useful in making the appropriate electrical connection.

Also forming part of the cathode 18 is circular element **18*b* connected to rod portion 18*a* via piece 18*c***.

The circular portion **18*b* of the cathode 18 is fixed within housing 14 to a position near but not touching substrate 15. The cathode 18 may be fixed in position by any convenient means (not shown). It has been found that placing cathode portion 18*b*** between 0.75 inches and 10 mils provides good coating.

The housing 14 which may comprise several pieces is assembled with the substrate 15 in position. The portion of the housing which is submerged is liquid tight. Prior to submergence the housing 14 is filled via opening 19 with an electrically conductive liquid which contains no electroplating solution. In this way the cathode 18 is prevented from being coated with the metal. The housing is submerged in the solution and the substrate 15 is coated in the manner described below. The housing 14 may then be removed and the substrate 15 replaced.

Switch 20 connects battery 21 to the anode 12 and cathode 18 during the electroplating process.

When switch 20 is closed an electrical current passes from cathode 18 through the conducting electrolyte solution to the anode 12. This current flow results in ions being formed from the metal in solution. The ions travel through the electrolyte and deposit on the surface of the substrate 15 forming the desired layer. The thickness of the layer may be controlled by controlling time of energization. For example, in a practical embodiment three volts dc applied for several minutes between the electrodes has been found sufficient to provide a coat 1 μm thick.

Thus, electroplating is accomplished without contact of the substrate 15. This eliminates possible damage to the fragile substrate. In addition, the circular shape of portion **18*b* which closely matches the circular shape of the substrate, provides for a more uniform coating than by the other contact methods. The isolation of the cathode 18 within housing 14 prevents it from being coated. The fact that the housing 14** is electrically non-conducting prevents it from being coated. These last two advantages result in the conservation of the coating metal which is expensive particularly in the case of gold.

It should be noted that a substrate may be masked with a non-conducting material such as photoresist prior to electroplating. After such masking deposition occurs only in the areas containing no photoresist. This makes possible the depostion of very fine patterns of electroplated metal.

While the present invention has been described in reference to mask substrates, it should be noted that the technique is applicable to coating any type of conducting substrate or object such as silicon wafers.

Other modifications of the present invention are possible in light of the above description which should not be limited beyond those limitations which appear in the claims which follow:

What is claimed is:

1. An apparatus for electroplating an electrically conductive substrate, comprising in combination;

a tank containing a plating solution, a liquid-tight housing disposed within said plating solution containing an electrically conductive liquid with said substrate forming one side of said housing, said housing freely removable from said tank, an anode disposed in said plating solution opposite one surface of said substrate, a cathode disposed within said housing adjacent to and fixed relative to the other surface of said substrate, said cathode and said substrate being of circular configuration, the portion of said housing not formed by said substrate being made of electrically non-conducting material, means applying an electrical potential between said anode and cathode for coating said one surface of said substrate without said cathode or housing being coated.

* * * * *